US008689997B2

(12) United States Patent
Johansson et al.

(10) Patent No.: US 8,689,997 B2
(45) Date of Patent: Apr. 8, 2014

(54) CONTAINER WITH LID

(75) Inventors: Torbjorn Johansson, Ulricehamn (SE); Joakim Steen, Ulricehamn (SE); Per Svennsson, Ulricehamn (SE); Thomas Hjalmarsson, Ulricehamn (SE)

(73) Assignee: Emballator Ulricehamns Bleck AB, Ulricehamn (SE)

( * ) Notice: Subject to any disclaimer, the term of this patent is extended or adjusted under 35 U.S.C. 154(b) by 0 days.

(21) Appl. No.: 13/343,486

(22) Filed: Jan. 4, 2012

(65) Prior Publication Data

US 2013/0068766 A1 Mar. 21, 2013

(30) Foreign Application Priority Data

Sep. 20, 2011 (SE) ..... 1150857

(51) Int. Cl.
*B65D 45/32* (2006.01)

(52) U.S. Cl.
USPC ..... 220/319; 220/782; 220/642

(58) Field of Classification Search
USPC ..... 220/782, 783, 640, 641, 642, 698, 700, 220/701, 319
See application file for complete search history.

(56) References Cited

U.S. PATENT DOCUMENTS

| | | | | |
|---|---|---|---|---|
| 3,604,588 | A * | 9/1971 | Winnick | 220/782 |
| 3,815,777 | A * | 6/1974 | Churan | 220/319 |
| 4,165,018 | A * | 8/1979 | Giggard | 220/284 |
| 4,625,890 | A * | 12/1986 | Galer | 220/319 |
| 2004/0232150 | A1 * | 11/2004 | John P. et al. | 220/319 |

FOREIGN PATENT DOCUMENTS

| | | |
|---|---|---|
| EP | 1 332 976 A1 | 6/2003 |
| SE | 531 312 C2 | 2/2009 |

* cited by examiner

*Primary Examiner* — Anthony Stashick
*Assistant Examiner* — Christopher McKinley
(74) *Attorney, Agent, or Firm* — Knobbe, Martens, Olson & Bear, LLP

(57) ABSTRACT

A container with a removable lid for sealing a container, wherein the container is rotationally symmetrical to an axis and has a circular bottom, the outer periphery of which is connected to a surrounding outer wall, which comprises at the top a first rim element that co-operates with a second rim element along the outer periphery of the lid. The lid comprises a circumventing U-shaped track, extending a predetermined way into the container and connects to the second rim element of the lid to an upper circular surface of the lid, wherein the said U-shaped track has an outer wall. The container has a protecting device, comprising a circumventing skirt, arranged to be placed in the U-shaped track, wherein a radial stiffening of the upper rim of the container and the lid are achieved to protect against external influence directed towards the upper rim.

11 Claims, 6 Drawing Sheets

CONTAINER WITH LID

BACKGROUND OF THE INVENTION

1. Field of the Invention

The present invention relates to a container, preferably in the form of a can with a lid. The object of the invention is to provide a container with improved characteristics regarding external influence.

2. Description of the Related Art

There are different container solutions for storage and transport of hazardous goods, for instance with some kind of fastening ring that keeps the lid and the container together even at excess pressure and gentle mechanical influence. There have, however, existed no good solutions for achieving simple closing of such containers, which at the same time counteracts deformation and/or involuntary opening of the container if it is exposed to influence in the form of blows or falls.

The invention is intended to solve the above problems regarding deformation or involuntary opening of a container exposed to external influence, as well as related problems regarding the opening function of the container lid.

SUMMARY OF THE INVENTION

The object of the present invention is to obtain a solution where a container with a lid can withstand external influence in the form of thrusts, blows, excess internal pressure and the like, while maintaining the sealing function of the container lid. This object is achieved with a container according to the invention.

Some embodiments relate to a container with a removable lid for sealing and opening a storage compartment in the container, which container is rotationally symmetrical with respect to a symmetry axis and has a circular bottom, the outer periphery of which is connected to a surrounding outer wall which at the top exhibits a circumventing rim element delimiting an opening in the upper surface of the container, the said first rim element co-operating with a second rim element, turned towards it, along the outer periphery of the lid, wherein the lid also comprises a circumventing U-shaped track, extending a predetermined way into the container and connecting the second rim element of the lid to an upper circular surface of the lid, and wherein the said U-shaped track has an outer wall, removably gripping the inner mantle surface of the cylindrical outer wall, wherein the container lid is provided with a protecting device, comprising a circumventing skirt, arranged to be placed in the U-shaped track, wherein the skirt is provided with at least one radial projection, extending over the whole width of the track, whereby a radial stiffening of the upper rim of the container and the lid are achieved to protect against external influence directed towards the said upper rim.

Other embodiments relate to a container, wherein the skirt is provided with at least one radial projection with an upper delimiting surface flush with the upper circular surface of the lid.

Other embodiments relate to a container, wherein the skirt is provided with at least one radial projection with an lower delimiting surface flush with the bottom of the U-shaped track.

Other embodiments relate to a container, wherein the skirt is provided with a radial projection that extends over the whole width of the U-shaped track.

Other embodiments relate to a container, wherein the skirt and the radial projection have an h-shaped cross-section.

Other embodiments relate to a container, wherein the skirt is provided with a plurality of radial projections with parallel side surfaces.

Other embodiments relate to a container, wherein the skirt is provided with radial projections with converging side surfaces.

Other embodiments relate to a container, wherein the skirt is provided with radial projections forming a framework in the U-shaped track.

Other embodiments relate to a container, wherein the skirt is snapped onto a contact surface in the U-shaped track.

Other embodiments relate to a container, wherein the skirt comprises an upper section which is snapped onto the said second rim element along the outer periphery of the lid.

Other embodiments relate to a container, wherein the skirt comprises an upper section that is snapped onto the circumventing first rim element, wherein the first rim element is formed from an extended element of the mantle wall, which element is bent to form a radially extending element.

Other embodiments relate to a container, wherein the upper section of the skirt comprises an elastic safety ring, which is snapped onto the circumventing first rim element.

Other embodiments relate to a container, wherein at least the safety ring presents at least one weakened place arranged to be broken open for opening the container, when the weakened place is exposed to breaking forces greater than a determined maximum load.

In the following text such terms as "radial," "axial" and the like are used with regard to a container which is rotationally symmetrical with respect to a central symmetry axis.

According to a first aspect the invention provides a container with a removable lid for sealing and opening a storage compartment in the container. The container is rotationally symmetrical with respect to a symmetry axis and has a circular bottom, the outer periphery of which is connected to a surrounding outer wall which at the top exhibits a circumventing first rim element delimiting an opening in the upper surface of the container. The first rim element co-operates with a second rim element, turned towards it, along the outer periphery of the lid. The lid further comprises a circumventing U-shaped track, which extends a predetermined way into the container and connects the second rim element of the lid to an upper circular surface of the lid. The U-shaped track has an upper outer rim connected to the second rim element, and its upper inner rim is connected to the said circular upper surface. At least a central part of the upper circular surface of the lid is situated in a plane arranged parallel to and between a plane through the second rim element and a plane through the lower surface of the track. The said U-shaped track comprises an outer wall, an inner wall and a lower bottom. The outer wall has an outer mantle surface, removably gripping the inner mantle surface of the cylindrical outer wall, whereby the lid is kept in place by being pressed a predetermined way down in the opening of the container.

The lid of the container is provided with a protecting device, which at least comprises a circumventing skirt, arranged to be placed in the U-shaped track. The skirt is provided with at least one radial projection that reaches over the whole width of the track, between its inner and outer walls in the radial direction. Hereby a radial stiffening of the upper rim of the container and the lid is achieved to protect against external influence directed towards the said upper rim.

The skirt is provided with at least one radial projection with an upper delimiting surface flush with the upper circular surface of the lid. At least one section of such a projection should preferably be arranged flush with the main direction of the central plane of the lid. In this way the force from e.g., a blow against the rim of the container can be transferred from its outer rim, via the protecting device, to the central part of the lid. Thereby a deformation of the outer rim of the container can be avoided. Alternatively the skirt can also be provided with at least one radial projection with a lower delimiting surface flush with the bottom of the U-shaped track. Such a protecting device may comprise a solid body, arranged to essentially fill the track, or a radial projection that extends over the whole width of the U-shaped track in one plane. Alternatively the protecting device may comprise at least one upper and one lower projection, extending radially in axially different planes over the whole width of the track. According to still another alternative the skirt and a radial projection may have an h-shaped cross-section.

According to a further example the skirt may be provided with a plurality of radial projections with parallel side surfaces or, alternatively, provided with radial projections with converging side surfaces.

According to a further example the skirt may be provided with radial projections 30 forming a framework in the U-shaped track. The term "framework" refers to a plurality of planar projections that extend in radial and/or tangential planes or in any chosen angle to these planes over the whole width of the U-shaped track. Such a framework may form a pattern in the form of triangles, squares, hexagons or a combination of these, extending radially downwards from the skirt. The said projections may pass through and/or be connected to one another to form a force receiving structure in the U-shaped track.

If the U-shaped track has a varying width in the radial direction, the said projections may also extend over the whole width of the track at least at the level of and/or in connection to a section of the U-shaped track which has a reduced width in the radial direction between the inner and the outer walls.

The protecting device is manufactured in a suitable way, e.g., by injection molding, and is pushed downwards onto the container to engage the track in the lid. Designing the protecting device in the form of profiled projections, as described above, can give substantial savings on weight and material.

The mounting of the protecting device on the container may for instance be done by snapping the skirt onto a contact surface in the U-shaped track. Such a contact surface may consist of a circumventing track or a corresponding elevation of the mantle surface of the 10 inner or outer walls of the U-shaped track. Alternatively, the skirt may comprise an upper section which is snapped onto at least the said second rim element along the outer periphery of the lid. A combination of these arrangements is also possible. Such a mounting may be used for a protecting device which is intended only to fill a track in the lid, alternatively to extend over the upper outer rim of the lid.

According to a preferred solution the skirt may comprise an upper section, which is snapped onto the circumventing first rim element of the container. The first element is preferably formed by an extended element of the mantle wall, which element is bent to form a radially projecting element. This bent element is arranged to co-operate with the said second rim element along the outer periphery of the lid. Such a mounting may be used for a protecting device which is intended to fill a track in the lid and to extend over the upper outer rim of the lid and down over the first rim element of the container.

The part of the upper section of the skirt that is snapped onto the circumventing first rim element may comprise an elastic safety ring, integrated with the protecting device. The safety ring is snapped onto the circumventing first rim element at the same time as the protecting device is pushed down in the U-shaped track in the lid. The elastic safety ring, which makes the lid safe from involuntary opening, is constructed as an annularly closed profile with a substantially U-shaped element forming an annular groove, open downwards. The said groove surrounds the first rim element of the container and the second rim element of the lid and keeps the lid on the container. An annular bulge, turned radially inwards, on the outer wall of the U-shaped element engages below the bent, radially projecting element of the first rim element of the can.

The protecting device with the integrated safety ring may present at least one weakened place, arranged to be broken open for opening the container, when the weakened place is exposed to breaking forces greater than a prescribed maximum load.

The safety ring may also present an intervention place for a breaking tool, such as a screw driver, in connection to the weakened place, to make it possible to break the safety ring open at the weakened part with a pivoting movement.

The weakened place is normally not visible to the naked eye, and the intervention place for the breaking tool consists preferably of a loop element of the safety ring, arranged on the outer side of the ring below the engaging bulge of the ring. The loop element may extend along the lower rim of the outer mantle surface of the outer wall of the U-shaped element and presents a through-going opening, which is open upwards and downwards. The weakened place is formed by manufacturing the safety ring by way of injection molding in an annular closed mold with one supply place for each weakened place. A space is preferably arranged between the inner side of the safety ring and the projecting element of the rim element of the opening to allow the safety ring to be pressed inwards at the time of a breaking movement.

The safety ring can preferably be integrated as a part of the protecting device, but it can also consist of a separate element which in safety mode is form locked onto the rim element of the lid by its profile shape with a surrounding upper rim element.

The lower surface and the diameter of the container and the upper surface and the diameter of the lid must be adapted to permit stacking of the containers.

To guarantee the function of the container different test methods are used, above all fall tests and hydraulic overpressure tests, which are usually performed when packages of this type are to be type tested. The test methods are described in a set of rules for transporting of hazardous goods (ADR-S from Myndigheten for samhallsskydd och beredskap, the Swedish Civil Contingencies Agency). The rules are comparatively complicated, but the method may be described briefly as follows.

The containers are dropped from a defined height and with a number of different fall angles. The containers are released with different fall angles over a solid surface in order to come down diagonally on the lid, diagonally on the bottom and flatly on the side. The fall tests must be performed over a fall plate from a predefined height, depending on which package group the container belongs to. For instance, for a metal container (package group 2), intended for fluid goods, the fall height is 1.2 meters. Three fall tests are to be performed, and a new package may be used for each test. The containers are during the test to be filled to the greatest permitted total weight (solid goods) or the greatest permitted density (fluid goods). The container may be harmed but must not leak after the fall in order to be approved.

In the hydraulic overpressure test the container is exposed to an inner overpressure during a predefined time, for instance 100 kPa during 5 minutes. During this time the container must not leak.

Both tests put great demands on the strength of the container and the lid and on the properties of the package.

The container and the lid according to the invention may be made from metal, such as tinplate, or a suitable plastic material. The container and the lid do not necessarily need to consist of the same material.

BRIEF DESCRIPTION OF THE DRAWINGS

The invention will be further described in the following text with reference to examples, which are illustrated by the accompanying drawings and figures. The figures are schematic and in no way intended to limit the scope of the invention.

DETAILED DESCRIPTION OF THE PREFERRED EMBODIMENT

Figure 1:
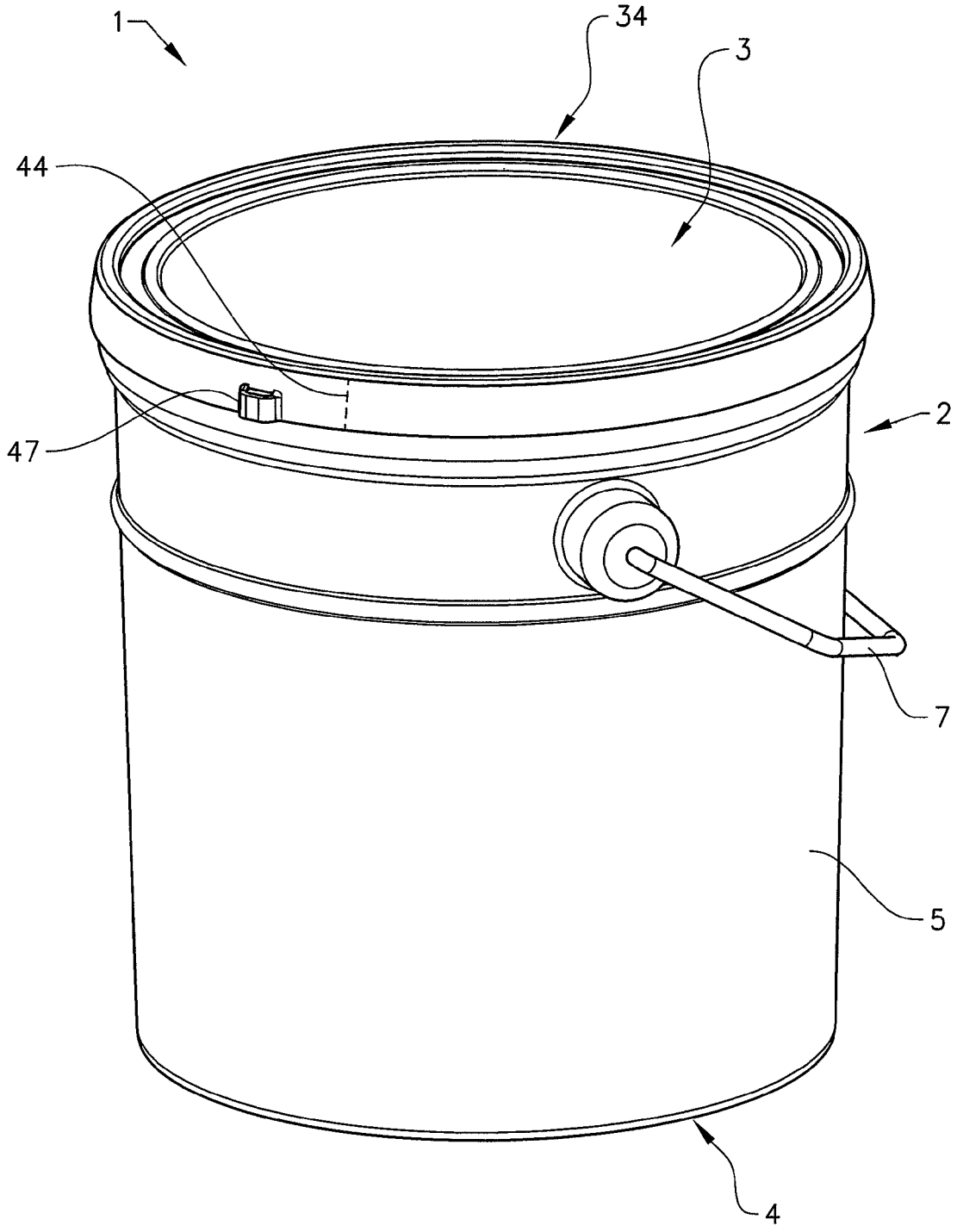
FIG. 1 shows a side view of a container of the invention.

FIG. 1 shows a side view of a container of the invention. The container 1 according to the invention is mainly intended for storage and transport of hazardous goods, where great demands are put on the package, so that it is not involuntarily opened when exposed to abnormal forces. The container of this example consists of a tin can 2 with a tin lid 3. Both the can and the lid may be made from a comparatively thin plate, usually a plate which has a uniform thickness and is made from a flat or wrapped plate blank, e.g., steel plate with a tin layer on at least one side and optionally a painted surface or a printed surface on the outer side. The plate may also be painted on the inside to improve the corrosion resistance. The plate thickness is for instance 0.1 to 1.0 mm, usually 0.1 to 0.5 mm. To lower the material consumption and thus the cost and the weight, for instance for paints, a comparatively small thickness of the material is chosen. By forming, especially of the rim elements, relatively good shape stability can still be obtained.

The can 2 presents at its lower side a bottom 4, which is usually flat and connected to a circumventing outer wall 5, extending upwards from the bottom, which is usually slightly conical or optionally cylindrical. The connection with the bottom is for instance made conventionally by folding and soldering to get a tight connection. The outer wall 5 is closed by a plate joint (not shown). A handle loop 7 is in the example fastened to the outer wall 5 of the can 2.

Figure 2:
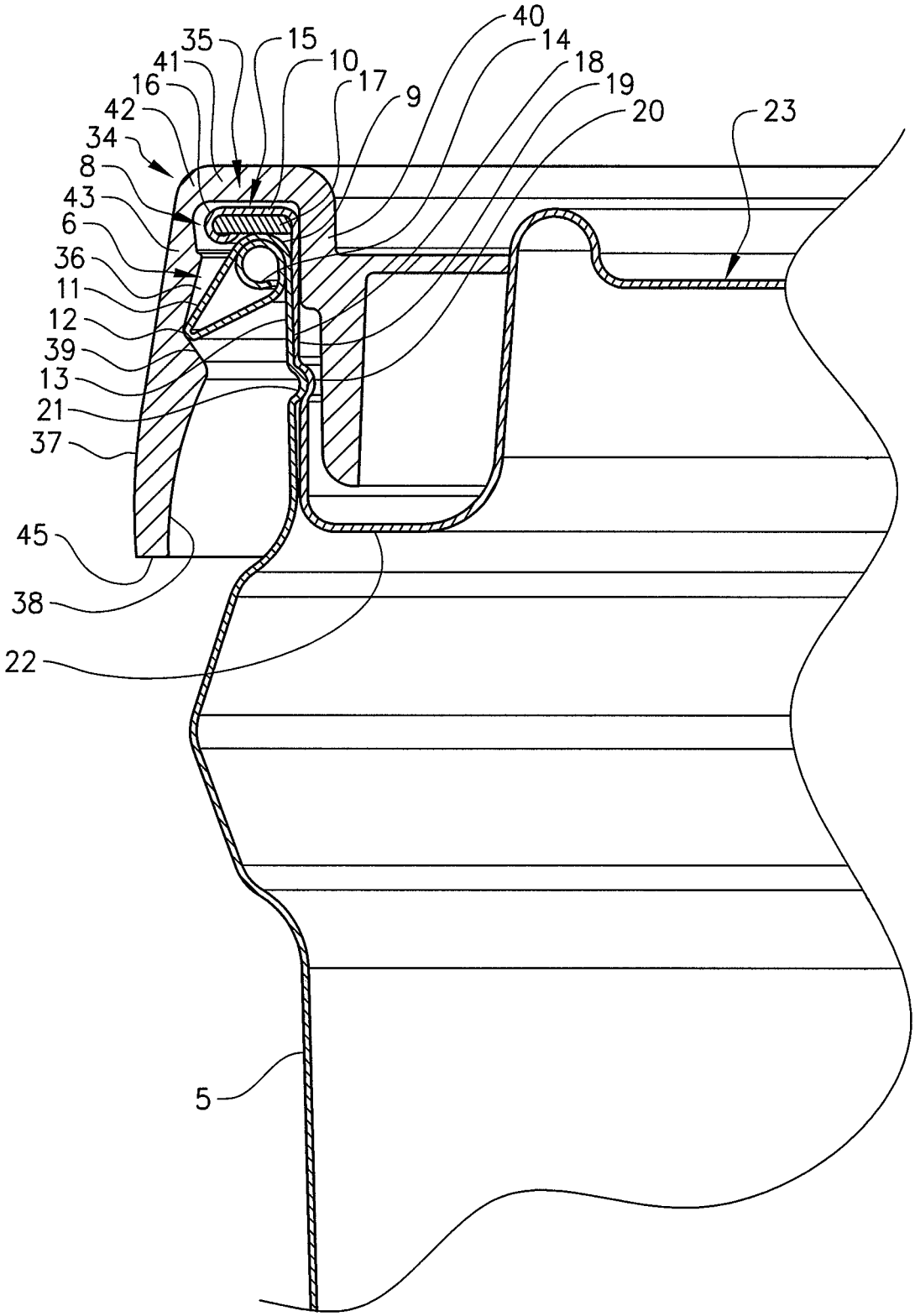
FIG. 2 shows a cross-section through a rim element of a container of the invention, with a lid and a protecting device.

FIG. 2 shows a cross-section through a rim element of a container of the invention, with a lid and a protecting device. As seen from the cross-section in FIG. 2 the mantle wall at the top becomes a circumventing, circular first rim element 6, enclosing a can opening, which is normally closed by the lid 3. This also presents a circumventing rim element 8, intended to connect tightly to the opening rim 10 of the can and to keep the lid in place when closed.

The first rim element 6 of the can is best seen in FIG. 2 and is formed by an extended element of the outer wall 5. This means that the same plate which is cut to form the outer wall 5 besides the in cross-section straight element, which forms the outer wall, also has an extension element, which forms both the first rim element 6 and another element, the function of which will be described further below.

The first rim element 6 of the can is formed by bending the outer wall 5 near the top outwards to give a rounded ridge 9, for instance in the form of an are, which from there becomes an outer rim element 11 in an angle downwards from the ridge and radially outwards, which in the cross-section in the example shown is straight and which as a whole has the form of the mantle of a truncated cone, i.e. the outer rim element 11 is substantially conical.

This conical rim element 11 near the bottom becomes an annular ledge rim 12, extending towards and leaning to the mantle surface 13 of the can below the first rim element 6, which is rolled to a hidden rim end 14 to strengthen the construction as a whole.

The lid 3, shown in the cross-section in FIG. 2, will now be further described. The lid 3 has a second rim element 15, which outermost presents a rim flange 16, which with a sealing ring 17 or gasket in between lies tight against the ridge of the can. The rim flange 16 of the lid becomes a substantially cylindrical element 19, connecting to the inside 18 of the mantle wall of the can, in the example provided with a bulge 20, which fits onto a corresponding bulge 21 in the mantle surface of the can, which keeps the lid closed. With the cylindrical element 19 the rim element of the lid forms a U-shaped track 22 to lose as little as possible of the volume in the container, i.e., the cover part 23 of the lid should lie as high as possible in relation to the first rim element 6 of the can.

Figure 3:
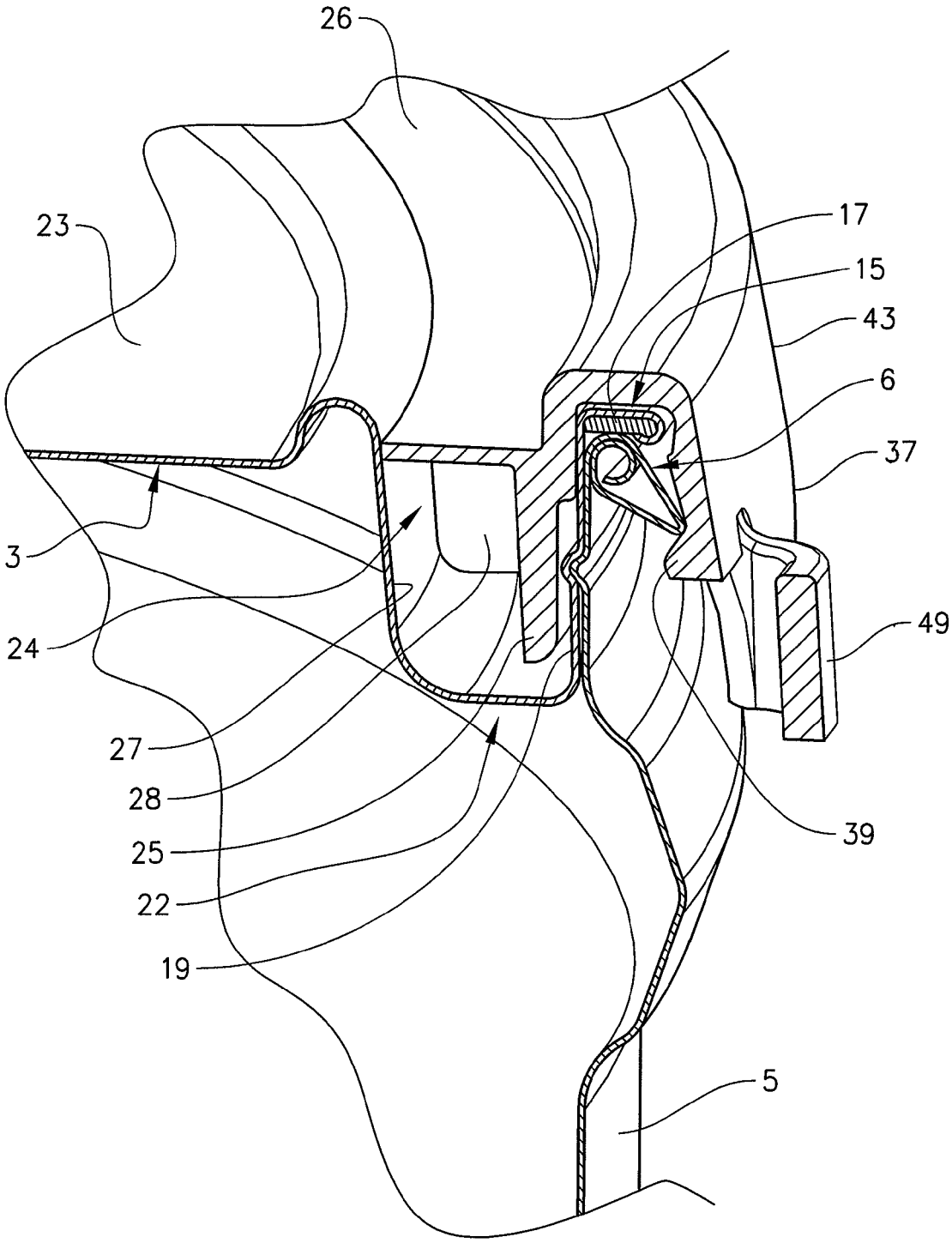
FIG. 3 shows a perspective view of the container and the cross-section of FIG. 2.

FIG. 3 shows a perspective view of the container and the cross-section of FIG. 2. The container lid is provided with a protecting device 24, which at least comprises a circumventing skirt 25, arranged to be placed in the U-shaped track 22. The skirt 25 is provided with at least one radial projection 26, which reaches over the whole width of the track 22, between its inner and outer walls 27, 19 in the radial direction. Hereby a radial stiffening of the upper rim of the container and the lid is achieved to protect against external influence directed towards the said upper rim. As can be seen in each of FIGS. 2 and 3, there is a gap between the skirt 25, including radial projection 26, and the inner wall 27 of the U-shaped track. Skirt 25 may include a projection that extends vertically downward into the U-shaped track.

The radial first projections 26 of the skirt 25 have an upper delimiting surface, which is flush or substantially flush with the upper circular surface 23 of the lid 3. At least a section of the first projection 26 should be arranged flush with or in the same plane as the main extension of the central plane 23 of the lid to give optimal stiffening. In this way the force from e.g. a blow against the upper rim of the container can be transmitted from its outer rim, via the protecting device 24, to the central part 23 of the lid. This counteracts deformation of the outer rim of the container. The skirt 25 of the aspect in FIG. 3 is provided with a plurality of radial second projections 28 with parallel side surfaces. These radial second projections 28 extend radially into the U-shaped track 22, perpendicularly to the first projection 26, from the inner surface of the skirt 25 to contact with the inner wall 26 of the U-shaped track 22. These radial second projections 28 help preventing the first projection 26 from folding under load. The distribution of the radial second projections 28 along the circumference of the skirt 22 is chosen with regard to the diameter, volume and content of the container and/or the material chosen for the container/protecting device, and to the forces the container is calculated to withstand. The radial second projections 28 also help distributing the force from a blow to the corner of the container in direction towards the inner wall 26 of the U-shaped track 22.

Figure 4:
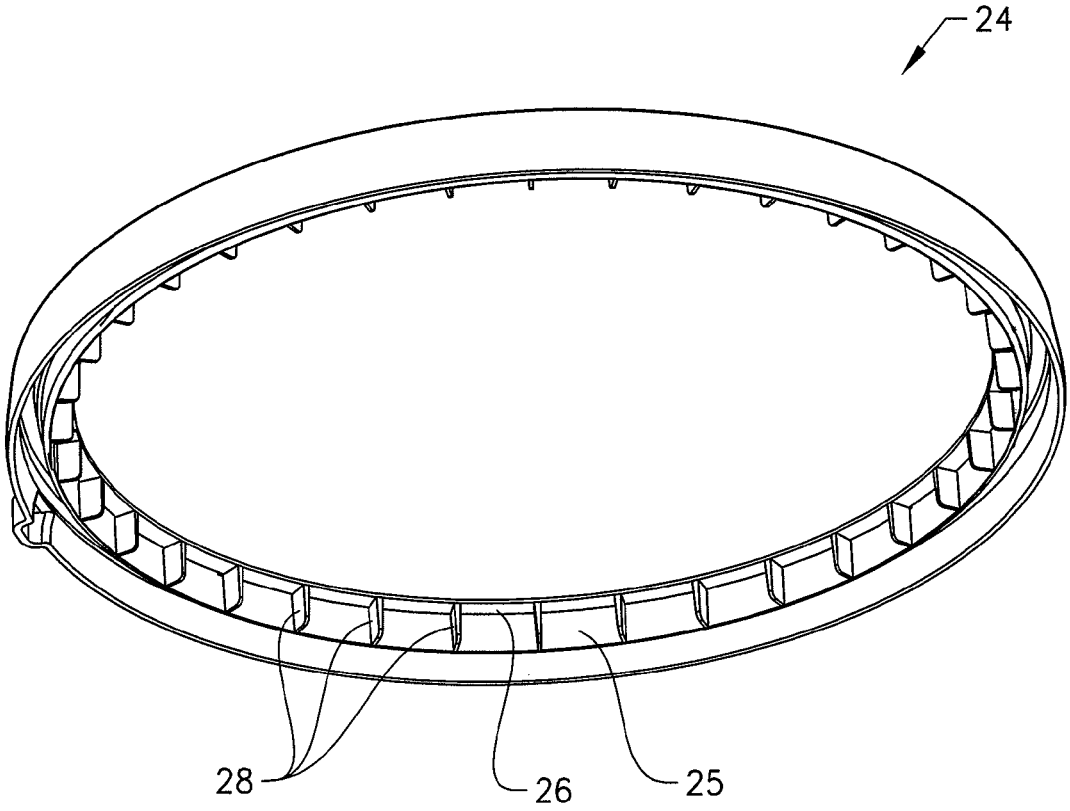
FIG. 4 shows a perspective view of a protecting device of the invention.

FIG. 4 shows a perspective view of the protecting device 24, shown in FIG. 3. As described above, the protecting device 24 comprises a circumventing skirt 25, arranged to be placed in a U-shaped track in a lid. The skirt 25 is provided with at least one radial projection 26, extending over the whole width of the track, between its inner and outer walls in the radial direction. The radial first projections 26 of the skirt 25 have an upper delimiting surface, which is preferably flush with or substantially flush with the upper circular surface 23 of the lid 3. In this way the force from e.g. a blow against the rim of the container can be transferred from its outer rim, via the first projections 26 of the protecting device 24, to the central part of the lid. The skirt 25 according to the aspect of FIG. 4 is provided with a plurality of radial second projections 28 with parallel side surfaces. These radial second projections 28 extend radially into the U-shaped track, perpendicularly to the first projection 26, from the inner surface of the skirt 25 to contact with the inner wall of the U-shaped track. These radial second projections 28 help preventing the first projection 26 from folding under load. The distribution of the radial second projections 28 along the circumference of the skirt 25 is chosen with regard to the diameter, volume and content of the container and/or the material chosen for the container/protecting device, and to the forces the container is calculated to withstand. The radial second projections 28 help distributing the force from a blow to the corner of the container in direction towards the inner wall of the U-shaped track. The example in FIG. 4 has 36 radial second projections 28.

According to an alternative example the skirt may be provided with radial projections with converging side surfaces. According to a further example the skirt may also be provided with at least one radial projection with a lower delimiting surface flush with the bottom of the U-shaped track. Such a protecting device may comprise a solid body, arranged to substantially fill the track, or a radial third projection extending over the whole width of the U-shaped track. A radial third projection may comprise at least one upper and one lower projection, extending radially in axially different radial planes over the whole width of the track. According to a further alternative the skirt and a radial projection may have an h-shaped cross-section. In the latter cases the respective first and third projections may be connected to strengthening radial projections, extending radially into the U-shaped track. According to a further example the skirt may be provided with radial projections forming a framework in the U-shaped track. The term "framework" refers to a plurality of preferably planar projections extending in radial and/or tangential planes or in any chosen angle to these planes over the whole width of the U-shaped track. Such a framework may form a pattern in the form of triangles, squares, hexagons or a combination of these, extending radially outwards from the skirt. The said projections may pass through and/or be connected to one another to form a force receiving structure in the U-shaped track.

If the U-shaped track has varying width in the radial direction along its vertical length any of the said first or third projections may extend over the whole width of the track at least at the level of and/or in connection to a section of the U-shaped track that has reduced width in the radial direction between the inner and the outer walls.

The protecting device is manufactured in a suitable manner, e.g., by way of injection molding, and is pressed down onto the container to engage the track in the lid. Designing the protecting device in the form of profiled projections, as described above, can give substantial savings on weight and material.

The mounting of the protecting device 24 on the container can be performed by snapping the skirt in place with an upper section which is snapped onto at least the said second rim element along the outer periphery of the lid (not shown). Preferably, the upper section is snapped onto the first rim element 6 of the can, as shown in FIGS. 2 and 3. Such a contact surface may also consist of a circumventing track or a corresponding elevation in the mantle surface of the inner or outer walls of the U-shaped track. An example of such a surface is the bulge 20 seen in FIG. 2.

FIGS. 2 and 3 show a preferred aspect, where the skirt 25 comprises an integrated upper section in the form of a safety ring 34, which is snapped onto the circumventing first rim element 6 of the container. For safe closing and holding of the lid 3 on the can 2 the container 1 according to FIGS. 2 and 3 is thus provided with the said safety ring 34, which surrounds the first rim element 6 of the can and the second rim element 15 of the lid. The safety ring 34 is made from an elastic plastic material, yet with good shape stability and strength, such as injection molded thermoplastics. The safety ring 34 consists of a circumferentially closed unit, in this example circular, arranged so that it in safety mode, as shown in FIG. 1, keeps the lid 3 sealed onto the can 2 by mechanically holding the circumference rims of the can and the lid.

The safety ring 34 is, as seen in the Figures, constructed as an annularly closed profile with a substantially U-shaped element 35, forming an annular groove 36, open downwards, which encloses the rim edges of the lid and of the container. On the outer side of the container 1 the U-shaped element 35 becomes an annular skirt 37, extending around the can, which on its inside 38 has a locking bulge 39, co-operating with the ledge rim 12 or nose, turned downwards and outwards, to lock the safety ring 34 and thus the lid 3 onto the can 2 in safety mode according to FIGS. 1 through 3. More exactly, the U-shaped element 35 shows a flange 40, extending downwards from the inside of the lid, which contacts the cylindrical element 19 of the lid tightly and further upwards becomes an upper element 41, which contacts the rim flange 16 of the lid and advantageously has an uprising rim bulge 42, facilitating the stacking of multiple containers, The protecting device 24 and the safety ring 34 are integrated by way of the downwards extending flange 40, On the outer side of the container an outer flange 43 of the U-shaped element 35 extends downwards and covers the joint between the lid and the can. The skirt 37 extends around the can at an even distance from its outer wall 5.

According to the invention, the protecting device 24 with the safety ring 34 presents a weakened place 44, arranged to be broken open at great enough breaking forces to open the can and gain access to the contents in its inner compartment, but never at the forces the container must withstand during other handling of the jar and its contents, i.e., when the container is in closed safety mode, as shown in FIGS. 1 through 3, The weakened place 44 is schematically shown in FIG. 1, but normally it is invisible to the naked eye. The weakened place 44 thus extends over the safety ring 34, straight over it or obliquely over it or in a non-straight line. It is not in all aspects quite necessary that the weakened place extends all the way from the lower outer rim 45 of the safety ring to its lower inner rim 46, but this depends on the technique for creating the weakened place and its strength, i.e., the strength of the weakened place may be regulated by the length of the weakened line.

Figure 5:
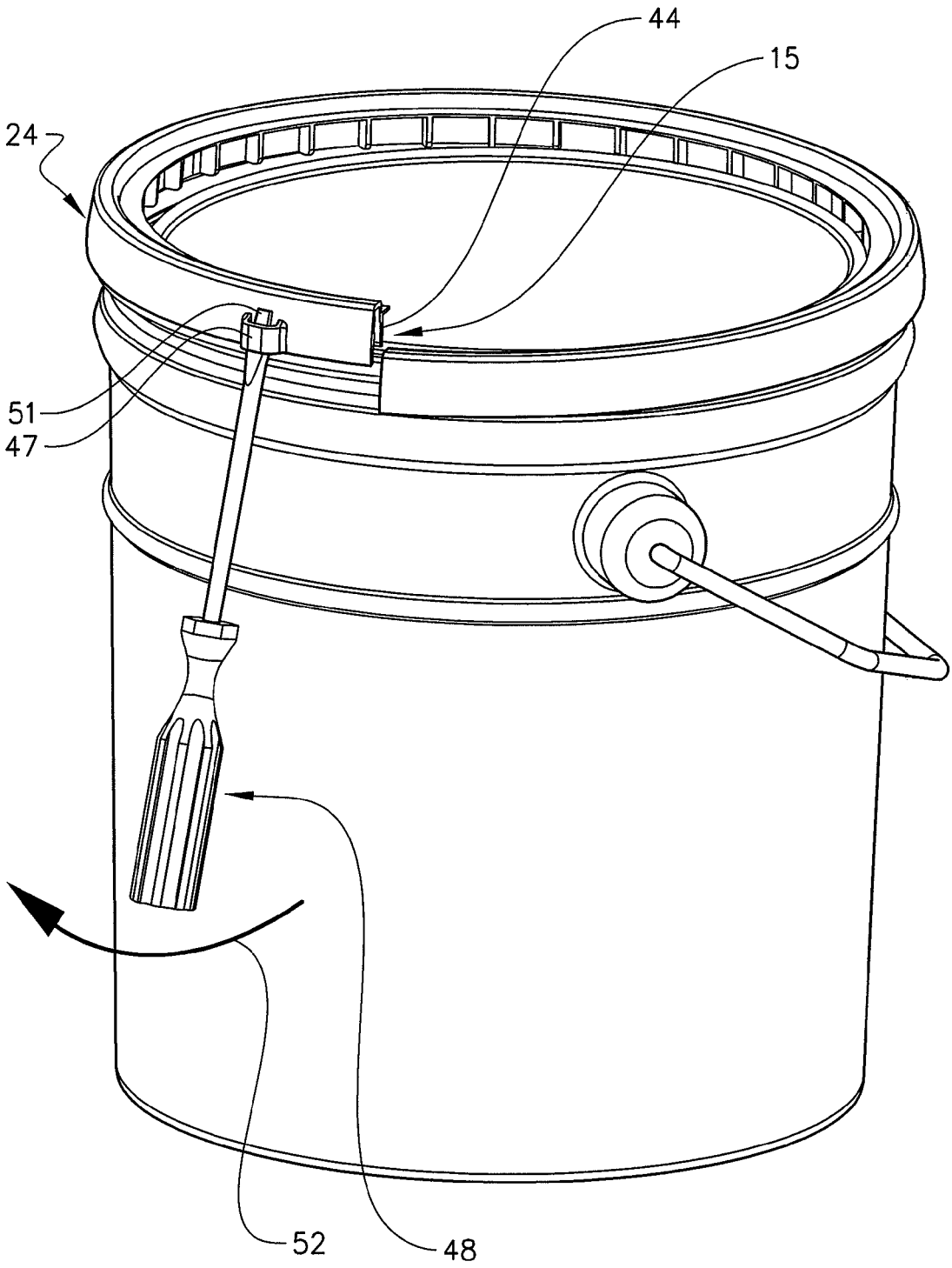
FIG. 5 shows a way to break and open the protecting device.

To create the necessary breaking forces for breaking the protecting device 24 with the safety ring 34 open at the weakened place 44 there is, according to the invention, arranged an intervention place 47 for a breaking tool 48—e.g., a screwdriver, see FIG. 5. The intervention place 47 in the example is designed as a loop 49 or a bridge or, alternatively, a pocket, which is integrated on the outer side of the safety ring 34 at its lower outer rim 45, on the outside of the skirt 37, forming a small compartment 50 for inserting the blade 51 of the tool, which can be supported over the loop against the outside of the outer flange 43. The intervention place is placed beside and in the vicinity of the weakened place, so a pivoting movement outwards and upwards, see the direction of the arrow 52, of the tool 48 gives great enough breaking forces to break the safety ring and open it at the weakened place 44, whereby the safety ring can be pulled off and the lid removed in a conventional way, e.g. with a suitable tool that can be inserted between the lid and the can. Optionally there is in some place arranged a flattening of the rim, permitting a tool to be inserted to an effective place for lifting the lid.

Figure 6:
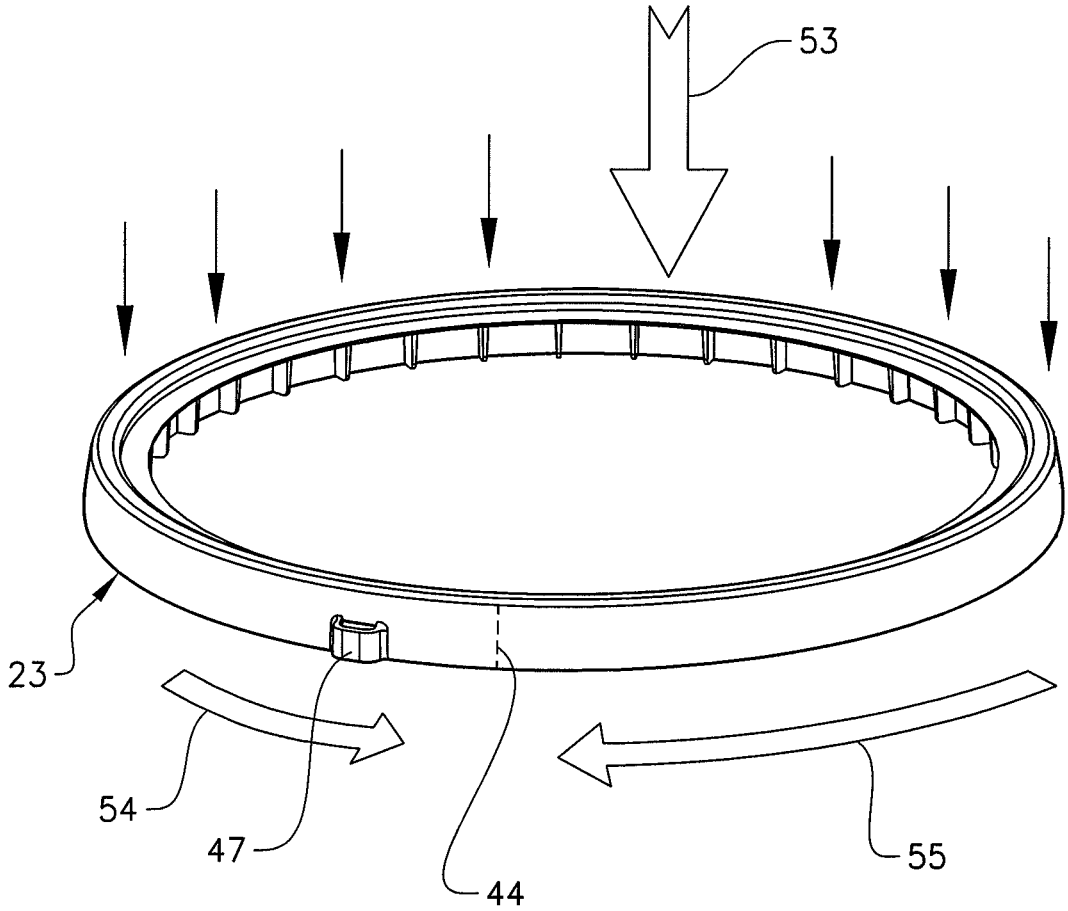
FIG. 6 schematically shows the flow direction of the plastic melt when the protecting device is injection molded.

The weakened place 44 according to an advantageous aspect is formed by manufacturing the safety ring 34 by way of injection molding in a substantially closed mold with an annular cavity with a single supply place, ingate, for fluid thermoplastics, which is thus heated to fluid form. By choosing the ingate diametrically opposite the position of the intended weakened place and simultaneously evacuating the air at the weakened place, the annular mold will be filled with two simultaneous streams of fluid thermoplastics, flowing with the same mutual speed and eventually forming two substantially semi-circular ring halves, where the two fronts of the thermoplastic mass meet at the position of the intended weakened place and flow together there. This process is schematically shown in FIG. 6. Because the surface of the mass has a somewhat lower temperature than the interior of the mass the molding together will not be perfectly homogenous with the same strength as the rest of the thermoplastics, which gives the weakened place, when the thermoplastic mass has solidified after the temperature has lowered and enough time has passed for total solidification. The mold is formed with a small duct to form the loop-shaped intervention place.

The invention is not limited to the example described above and shown in the Figures but can be varied within the scope disclosed herein. For instance, the can and the lid can have another shape, e.g. an oval shape or a shape with several, e.g., four, corners, which are rounded. The mounting of the safety ring can be performed in different stages and is allowed by the co-operating conical surfaces 11 on the can 2 and the surface below the locking bulge 39. The safety ring may also be injection molded in place. This is appropriate for instance when the safety ring is fully integrated with the lid and injection molded onto the opening rim element of the lid, i.e., is stuck to the lid as long as the safety ring is not broken, at which time the ring should be easily removed. It is in principle possible to have two or more weakened places and two or more intervention places for the breaking tool, but it is not self-evident that the number of weakened places and of intervention places is the same. Two or more weakened places are formed e.g., if two or more supply places are arranged symmetrically in the mold, which gives a corresponding number of plastics streams meeting midway and together forming two or more weakened places. According to another alternative the protecting device and the safety ring can be pulled off by manually or with the help of a suitable tool lifting the outer part of the safety ring around the locking bulge of the container.

What is claimed is:

1. A storage compartment comprising a container, a removable lid and a protecting device, wherein the container is rotationally symmetrical with respect to a symmetry axis and has a circular bottom, the outer periphery of which is connected to a surrounding outer wall, which at the top exhibits a circumventing first rim element that delimits an opening in the upper surface of the container;

wherein the lid comprises a second rim element along the outer periphery of the lid, configured to cooperate with the first rim element of the container, wherein the lid also comprises a circumventing U-shaped track configured to extend a predetermined way into the container and to connect the second rim element of the lid to an upper circular surface of the lid, and wherein the U-shaped track has an outer wall, configured to removably grip an inner mantle surface of the cylindrical outer wall of the container; and wherein the protecting device comprises a circumventing skirt, configured to be placed in the U-shaped track, wherein the skirt comprises an upper section configured to be snapped onto the circumventing first rim element, wherein the circumventing first rim element is formed from an extended element of the mantle wall, which element is bent to form a radially extending element, and wherein the skirt comprises at least one first radial projection configured to extend over the whole width of the U-shaped track, wherein the at least one first radial projection comprises an upper delimiting surface flush with the upper circular surface of the lid and a bottom delimiting surface configured to create a gap between said bottom delimiting surface and an upper surface of the bottom of the U-shaped track, whereby the protecting device provides a radial stiffening of an upper rim of the container and the lid to protect against external influence directed towards the upper rim.

2. A storage compartment according to claim 1, wherein the skirt of said protecting device further comprises at least one second radial projection with a lower delimiting surface flush with the bottom of the U-shaped track.

3. A storage compartment according to claim 1, wherein the skirt and the radial projection have an h-shaped cross-section.

4. A storage compartment according to claim 1, wherein the skirt is provided with a plurality of radial second projections with parallel side surfaces, wherein the radial second projections extend radially into the U-shaped track, perpendicularly to the at least one first radial projection, from the inner surface of the skirt to contact with the inner wall of the U-shaped track.

5. A storage compartment according to claim 1, wherein the skirt is provided with radial projections with converging side surfaces.

6. A storage compartment according to claim 1, wherein the skirt is provided with radial projections forming a framework in the U-shaped track.

7. A storage compartment according to claim 1, wherein the skirt is snapped onto a contact surface in the U-shaped track.

8. A storage compartment according to claim 1, wherein the upper section of the skirt comprises an elastic safety ring, which is snapped onto the circumventing first rim element.

9. A storage compartment according to claim 8, wherein at least the safety ring presents at least one weakened place arranged to be broken open for opening the container, when the weakened place is exposed to breaking forces greater than a determined maximum load.

10. A storage compartment according to claim 1, wherein the outer wall of the U-shaped track comprises a bulge that fits onto a corresponding bulge in the mantle surface of the cylindrical outer wall of the container.

11. A storage compartment according to claim 1, wherein the skirt comprises a projection that extends vertically downward into the U-shaped track.

* * * * *